United States Patent [19]

Ferrari

[11] Patent Number: 4,915,545

[45] Date of Patent: Apr. 10, 1990

[54] LARGE SIZED UNDERGROUND STORAGE TANK WITH STRUCTURAL STABILITY

[75] Inventor: Franco Ferrari, La Spezia, Italy

[73] Assignee: Nino Ferrari USA Inc., Montclair, N.J.

[21] Appl. No.: 212,911

[22] Filed: Jun. 29, 1988

[30] Foreign Application Priority Data

Jan. 29, 1988 [IT] Italy ..... 12413 A/88

[51] Int. Cl.[4] ..... E04B 1/92

[52] U.S. Cl. ..... 405/53; 52/249; 220/435; 220/444; 405/52

[58] Field of Search ..... 405/53–59; 220/1 B, 435, 444, 455, 5 A; 52/249

[56] References Cited

U.S. PATENT DOCUMENTS

| | | | |
|---|---|---|---|
| 2,373,270 | 8/1945 | Skolnik | 220/1 B X |
| 2,382,171 | 4/1945 | Pomykala | 405/53 |
| 3,545,213 | 12/1970 | Sebor et al. | 405/150 |
| 4,032,608 | 6/1977 | Zinniger et al. | 220/444 X |
| 4,117,947 | 10/1978 | Androulakis | 220/435 |
| 4,181,237 | 1/1980 | Kenyon et al. | 220/1 B X |
| 4,240,562 | 12/1980 | Holschlag | 220/1 B X |

FOREIGN PATENT DOCUMENTS

| | | | |
|---|---|---|---|
| 938726 | 2/1973 | Italy . | |
| 938727 | 2/1973 | Italy . | |
| 0154817 | 12/1979 | Japan | 220/435 |

*Primary Examiner*—Dennis L. Taylor
*Attorney, Agent, or Firm*—Jacobs & Jacobs

[57] ABSTRACT

The large-sized underground storage tank is consisting of a metal shell (1), a static facing in reinforced or unreinforced concrete (2) and filling material (4) packed in the hollow space between the two above mentioned surfaces; this filling is consisting of blown bitumen having plasticity properties which provide a stress resisting interaction between the tank shell and its static facing, thus greatly improving the stability of the overall tank structure; hence the possibility to reduce the design strength parameters and to cut the cost of the final product.

9 Claims, 2 Drawing Sheets

LARGE SIZED UNDERGROUND STORAGE TANK WITH STRUCTURAL STABILITY

This patent covers large-sized underground storage tanks for liquids of any kind whatsoever, the structural stability of these tanks being generated by the interaction between the internal metal shell, the static external facing and the filling packed in the hollow space between these inner and outer tank walls.

Such well known large-sized underground tanks are usually cylinder shaped and are installed along their horizontal axis. Construction and conservation techniques are also well known to ensure low cost and long life benefits.

In particular, the Italian Pat. Nos. 938,726 and 938,727 specify the manufacture of large-sized underground storage tanks with the utilization of rolled metal elements or rings of considerable width and properly L-shaped edges, so that these rings, after jointing, will form transverse and longitudinal channels for recovery and location of any leaks. These large-sized shaped metal components allow for easy and low-cost installation of the metal struture inside the static concrete outer facing wall acting as a supporting structure and protection of the metal tank, since the number of components to be handled and the welds thus necessary are greatly reduced as compared with previous installation techniques.

According to these known Patents, the metal structure is supported by the static facing wall by means of insulating studs or U-legs and the hollow space between the metal structure and static facing is filled by pouring or injecting a hot filler so as to provide proper corrosion protection; blown bitumen being mostly used as a filler. Furthermore, a direct current generator cathodizes the metal structure of the underground tank.

The overall static stability of these large-sized underground tanks is currently ensured by providing the metal shell and its static facing with separate static stability without taking reciprocal interactions into account.

This Patent has the aim to provide these tanks with optimum stability through proper consideration of the interaction between the metal structure, the static facing and the filler so that these components are directly contributing to the structural stability of the tank, especially when it is fully loaded.

When this aim is achieved, it will be possible to reduce the strength parameters and design thickness of the metal structure and of the facing wall, with considerable cost savings.

It is well known that filling of the tanks with the liquid to be stored generates inside the metal shell a downwards increasing hydrostatic pressure which may cause deformation of the shell. It is known that the metal walls of the tank are usually secured to the static facing wall by insulating studs or U-legs so that deformation of the shell is counteracted in limited areas (studding area) by the static facing. Thus, the metal struture is now, at least theoretically, capable to withstand inner hydrostatic pressure or has at least prudential design parameters since the static facing wall is contributing to the strength to a very limited extent.

In present tank design, the material used for filling the empty space between the metal shell and static outer wall of the tank is not interacting at all or is only empirically counteracting the hydrostatic pressure and the shell deformation, while its main function is to protect the tank form corrosion.

On the other hand, an inward thrust is applied by the surrounding soil to the outerface of the static external facing, and in this case too, according to current design, the static facing has to withstand such thrusts as well as any seismic forces, so that the tank structure has to be properly calculated for these stress values.

Hence, part of the problem concerns the choice of the material to be used for filling in of the hollow space between the metal shell and static outer wall.

According to known procedures, this filling material has to be either hot poured or injected into the hollow space through narrow slots or "windows" in the metal structure and the filler have an excellent flowability, so as to fill up any voids and to stick to the metal and facing walls so as to obtain an integral structure after the liquid has cooled down.

In addition, an important feature of this invention provides that this filling material shall not be too fluid or deformable after it has cooled down, nor shall it be too compact and rigid. Because, if too fluid or deformable, it would be unable to counteract deformation of the steel plates and would not transmit them to the static outer wall or vice-versa. Conversely, if too rigid and compact, the structure would be subject to brittleness, veining or failure, causing structural non uniformity.

This invention has the aim to suggest the best filler type for transmission of deformation stresses from the metal structure to the outer facing, so that the outer wall can efficiently counteract such stresses and provide stability for the whole tank assembly, while the metal shell will contribute, although to a lesser extent, to withstand the action of the soil on the static facing wall.

It is clear that all three tank components, i.e. the metal shell, filling material and static outer wall are forming one single structural unit, defining the stability of the whole assembly, also in case of any seismic actions.

According to this invention, the filling material best suitable to achieve the above mentioned aim would be hot blown bitumen, having the following characteristics:

Penetration depth at 25° C.: 20–30 dmm;
Softening point: 80°–115° C.;
Fraas fracture point: −5° to −12° C.;
Ductility at 25° C.: min 3 cm;
Flash point: min 250°–260° C.;
Specific gravity: 1.01 to 1.05 gr/cc; When using this material to fill the hollow space between the metal shell and the static facing, it will be possible to design the metal as well as the static facing walls with smaller sections as compared with present design criteris in which the various components are considered independently from each other.

For purely indicatory purposes for instance, with reference to FIG. 2, if the shell is now designed to withstand outward thrust having a +Se value and the facing is now designed to withstand inward thrusts having a value of −Pi, this invention would make it possible, through the interaction between these two components, to adopt a design value of +S'e, that is lower than the previous stress value +P'e acting on the facing and the latter can be designed for a strength value −P'i which is lower than the previous value −Pi for the stresses −S'i applied by the shell, although the latter situation is rather theoretical and will not affect the design in the practice. In particular, it will thus be possible to reduce the plate thickness of the rings, but this will require, according to the invention, some modifications in the construction of the transverse and longitudinal drainage channels. According to this invention, these channels are obtained from omega shaped sections rather than from plates with flanged edges as indicated above, since cold bending of these edges, added to welding would cause work-hardening of the metal and weaker areas which might lead to failure. Furthermore, strengthening of the rings and of the longitudinal channels with the aid of external sections is deemed advisable so as to obtain the strength required for the shell (also during handling and installation of the plates) even when the plate thickness is reduced.

The invention in question is illustrated for exemplification purposes in the following tables, in which.

Figure 1:
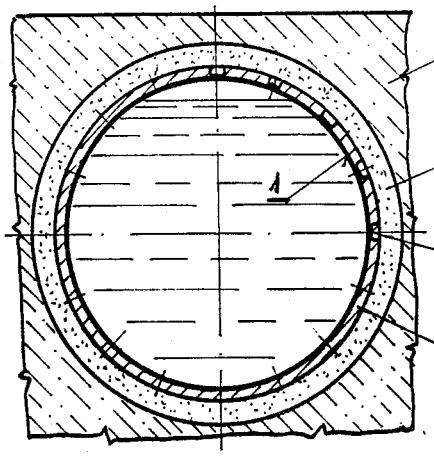
FIG. 1 shows a schematic cross section of an underground storage tank.

With reference to FIG. 1, 1 refers to the metal shell of the storage tank and 2 to the static unreinforced or reinforced concrete facing, while 3 refers to the surrounding soil. The metal shell 1 is supported inside the static facing 2 by insulating studs or U-legs 12, secured to the outer wall 2 by concrete anchors 14, fastened onto the transverse drainage channels 13 (see also FIG. 6).

The hollow space between the shell 1 and the static facing 2 is filled with material 4, hot poured or injected through slots or windows which can be closed, located in the transverse channels of the shell 1.

According to this invention, the filler 4 shall be able to transmit static thrusts from the shell 1 to the static facing 2 and vice versa, hot blown bitumen having the characteristics listed below has been found most suitable for this purpose:

Penetration depth: 20–30 dmm;

Softening point: 80°–115° C.;

Fraas fracture point: −5°/−12° C.;

Ductility at 25° C.: min 3 cm;

Flash point: min 240°–260° C.;

Specific gravity at 25°/25° C.: 1.01–1.05 gr/cc. When cooled down, this hot blown bitumen has the plasticity necessary to transmit the thrusts without causing permanent deformation or failure of the storage tank components and this bitumen is poured into the hollow space at a temperature of about 200°–220° C., so as completely to fill this space between the shell and the static facing.

Obviously, this bitumen, although deemed efficient for implementation of this invention, may be replaced by other material provided it satisfies the above mentioned requirements, can easily be poured or injected and has sufficient plasticity to ensure a resisting interaction between the tank components, while protecting the outer shell surface from corrosion.

Figure 2:
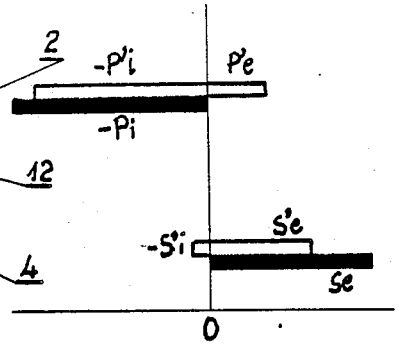
FIG. 2 shows a diagram for comparison of the design strength calculated according to known techniques (black rectangles) with the design values adopted in this invention (white rectangles)
Figure 3:
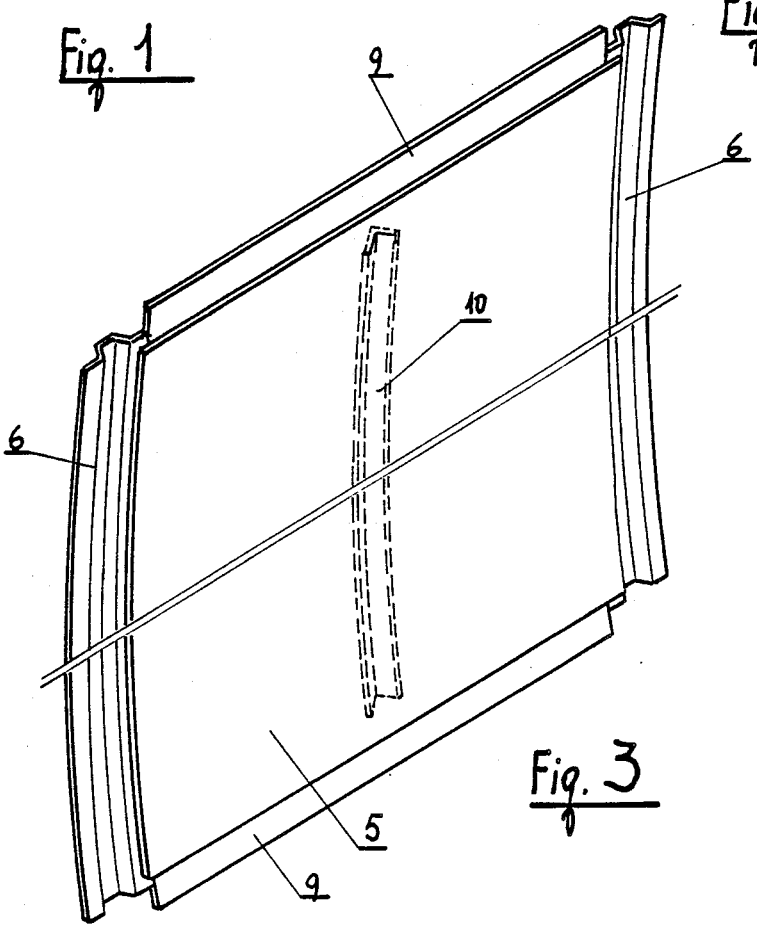
FIG. 3 shows a perspective view of one ring of the metal shell, modified according to the invention.
Figure 4:
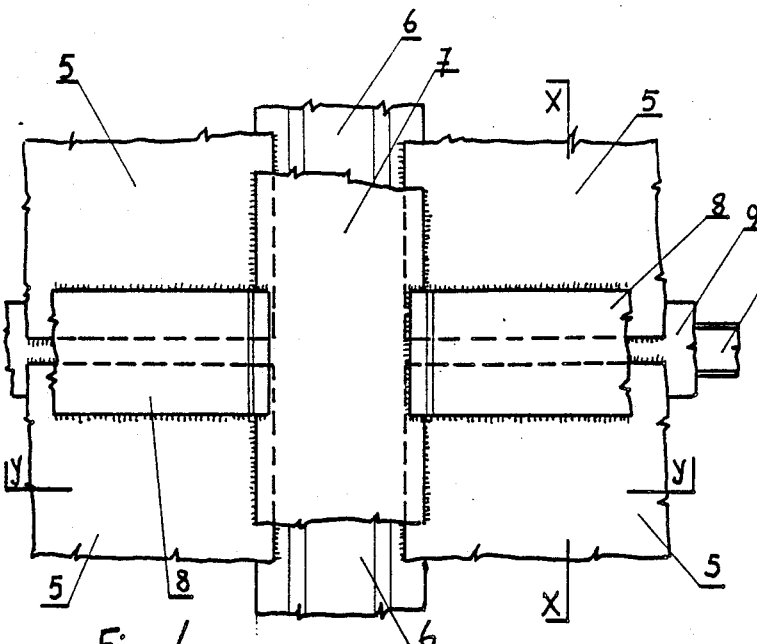
FIG. 4 shows an assemblage node of four rings, viewed from inside the tank, together with the corresponding transverse and longitudinal drainage channels.
Figure 5:
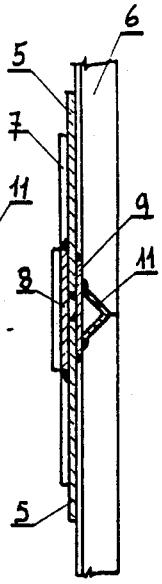
FIG. 5 shows the vertical cross section according to the X—X axis in FIG. 4.

As already explained before, the utilization of this filling material will provide stability for the whole shell-/facing assembly calculated for lower stress values of the section as compared to present design criteria, as illustrated in FIG. 2.

Particularly important is the possibility to fabricate the shell 1 with rings of less thickness, thus cutting the costs of installation and of the finished system. A reduced thickness will however require some changes in the fabrication of the rings and in the design of the transverse and longitudinal drainage channels, since present design rings might have some areas weakened by concomitant bending and welding of the shell plates.

Therefore according to FIGS. 3 thru 6, each ring is obtained from rolled plates 5 with unshaped edges. Transverse channels are provided by external omega shaped sections 6, overlapping the plates located near to each other but with some spacing and internally closed by flats 7, these sections 6 and 7 being obviously rolled according to the tank curvature.

According to this invention, the longitudinal channels are obtained by two overlapping flats 8 and 9 welded along the flat edges of the slightly spaced sheets, since the shaped edges of the sheets 5 have been eliminated.

According to the invention, the sheets 5 are also centrally stiffened by a preferably L-shaped transverse outer section 10, whereas the external flats 9 of the lengthwise channels are strengthened by other, preferably L or otherwise shaped sections 11.

Figure 6:
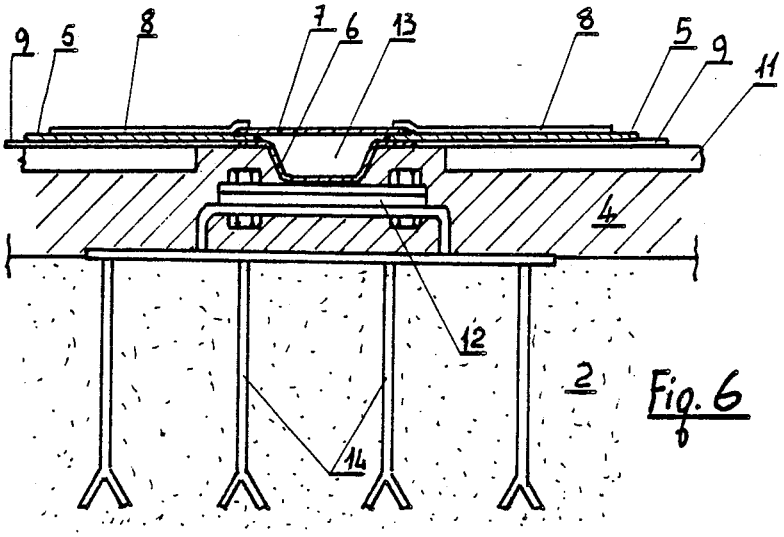
FIG. 6 shows the longitudinal section according to the Y—Y axis in FIG. 4.

For exemplification, FIG. 6 shows an insulating U-leg 12, connecting the shell 1 and the static outer facing 2; this U-leg 12 being fastened by welding to the outer surface of the omega section 6 of the transverse channels 13 and by mean of the anchors 14 to the static facing 2.

From the above, it clearly appears that large-sized underground installed tanks, by adopting the above mentioned filling material and after modification of the ring edges and the configuration of the sections so as to form suitable drainage channels, will have a particularly low-cost and stress resisting structure, since all tank components are acting in its support.

Obviously, the statements regarding the shell body also refer to its top and bottom both in flat and in crowned configuration.

The specifications regarding cylindrical tanks with horizontal axes are of course also valid for tanks of any other form and lay-out (upright, spherical tanks etc.).

I claim:

1. Underground installed storage tank consisting of an internal metal sheel (1) a static external facing in simple or reinforced concrete (2) and a filler (4) to be poured into the hollow space between the two walls, the metal shell (1) being formed by large rings (5) placed side by side and having edges fitted with channels for drainage, location and recovery of any leaks or drippings, characterized by the fact that the filler (4) is a hot injected or poured material which, after cooling, has sufficient plasticity to transmit any stresses from the metal to the static facing structure and vice-versa, so that all tank components are contributing to the stability of the assembly and so that the tank may be designed for a lower stress resistance (S'e,−P'i) than adopted in conventional design (Se,−Pi) resulting in savings in the metal shell structure and static facing wall.

2. Tank as described in claim 1, characterized by the fact that the filler is a hot blown bitumen having the following characteristics:

Penetration depth: 20–30 dmm.

Softening point: 80°–115° C.

Fraas fracture point: −5°/−12° C.

Ductility at 25° C.: min 3 cm.

Flash point: min 240°–260° C.

Specific gravity at 25°/25° C.: 1.01–1.05 gr/cc.

3. Tank as described in claim 2, characterized by the fact that this blown bitumen is poured or injected into the hollow space between the metal shell (1) and the static facing (2) at a temperature of about 200°–220° C.

4. Tank as described in claim 1, characterized by the fact that the shell will be designed with rings (5) of less thickness than used in current shell design, because of the interaction between the shell (1) and facing (2).

5. Tank as described in claim 4, characterized by the fact that the rings (4) have flat edges.

6. Tank as described in claim 4, characterized by the fact that transverse drainage channels (13) are obtained with the aid of external omega shaped sections (6) welded onto the transverse edges of the rings (5), the latter being placed next to each other but with some spacing, internally closed by flats (7), these sections (6, 7) being rolled according to the tank curvature.

7. Tank as described in claim 4, characterized by the fact that the longitudinal channels aree obtained from flats (8, 9), internally and externally welded to the longitudinal edges of the rings (5) approached to each other with some spacing.

8. Tank as described in claim 4, characterized by the fact that a transverse section (10) is acting as as transverse and central stiffener of the rings (5).

9. Tank as described in claim 4, characterized by the fact that a longitudinal section (11) is externally strengthening the outer flats (9) forming the longitudinal channels.

* * * * *